United States Patent [19]

Hara et al.

[11] Patent Number: 4,577,604

[45] Date of Patent: Mar. 25, 1986

[54] CONTROL SYSTEM FOR FUEL PUMP FOR INTERNAL COMBUSTION ENGINE

[75] Inventors: Yoichi Hara, Hiratsuka; Yasuo Seimiya, Kanagawa, both of Japan

[73] Assignee: Nissan Motor Company, Limited, Yokohama, Japan

[21] Appl. No.: 655,554

[22] Filed: Sep. 28, 1984

[51] Int. Cl.[4] ..... F02M 19/00

[52] U.S. Cl. ..... 123/397; 123/358

[58] Field of Search ..... 123/397, 358

[56] References Cited

U.S. PATENT DOCUMENTS

| | | | |
|---|---|---|---|
| 3,587,545 | 6/1971 | Ballou | 123/497 |
| 3,822,677 | 7/1974 | Reddy | 123/497 |
| 3,967,598 | 7/1976 | Rachel | 123/497 |
| 4,096,830 | 6/1978 | Long | 123/497 |
| 4,430,980 | 2/1984 | Pidgeon | 123/497 |

*Primary Examiner*—Ronald B. Cox

*Attorney, Agent, or Firm*—Schwartz, Jeffery, Schwaab, Mack, Blumenthal & Evans

[57] ABSTRACT

A fuel pump control system controls the operating speed of the fuel pump to control the fuel pressure in a fuel supply circuit for a internal combustion engine. The control system includes a main control circuit constantly connecting a fuel pump driver to a vehicle battery which acts as a power source and a normally-open auxiliary circuit. The main control circuit adjusts the power supply to the fuel pump driver to adjust the operating speed of the fuel pump to either a first maximum or a second minimum speed. The auxiliary circuit establishes electrical communication between the fuel pump driver and the battery when a demand for increasing of the fuel pressure in the supply line and thus for enrichment of the air/fuel mixture beyond a predetermined value is detected on the basis of one or more preselected engine operating parameters.

14 Claims, 6 Drawing Figures

CONTROL SYSTEM FOR FUEL PUMP FOR INTERNAL COMBUSTION ENGINE

BACKGROUND OF THE INVENTION

The present invention relates generally to a control system for a fuel pump in a fuel supply system of an internal combustion chamber. More particularly, the invention relates to a fuel pump control system for controlling fuel pressure in a fuel supply system in accordance with the engine operating conditions.

In general, a fuel pump for a fuel supply system of an internal combustion engine, such as a gasoline engine, is provided in a fuel supply circuit to draw fuel out of a fuel tank and drive same through the fuel supply circuit at a certain pressure.

Published Japanese Patent Application (Tokkai) Showa No. 54-163219, published on Dec. 25, 1979, discloses a fuel pressure control system which adjusts the voltage applied to a fuel pump depending upon the engine load. In the disclosed system, a limited voltage will be applied to the fuel pump under relatively low engine load conditions and a full voltage will be applied to the fuel pump under relatively high engine load conditions. Control of supply voltage is performed by a controller including a power transistor rendered conductive or nonconductive according to engine operating conditions, and a resistor connected in series to limit the supply voltage under low engine load conditions and disconnected to allow application of full voltage to the fuel pump under high engine load conditions.

In such a fuel pump control system, the controller is mounted in the front end of the passenger compartment or in the engine compartment. On the other hand, the fuel pump is mounted near the fuel tank which is in the rear end of the vehicle in most cases. As a result, the wiring connecting the controller and fuel pump is so long that the supply voltage may drop significantly. This causes a lack of power of the fuel pump during engine start-up under a demand for sudden acceleration, which in turn causes a leaner air/fuel mixture than required. Furthermore, the lack of fuel pressure increases the probability of vapor-lock in the fuel supply system under relatively high temperature conditions.

The present invention is intended to improve the prior system by directly connecting a vehicle battery to the fuel pump under certain conditions to ensure sufficient supply voltage for the pump.

SUMMARY OF THE INVENTION

Therefore, it is an object of the present invention to provide a fuel pump control system which responds to demands for enrichment of the air/fuel mixture by applying sufficient power to the fuel pump under high load conditions.

Another and more specific object of the present invention is to provide a fuel supply control system which can respond to enrichment demands in a manner precisely in accordance with predetermined engine operating parameters.

In order to accomplish the above-mentioned and other objects, a fuel pump control system includes a circuit connecting a power source to a fuel pump directly. A switch is inserted in the circuit. The switch is responsive to an enrichment demand to close and thereby establish a direct electrical connection between the power source and the fuel pump. Another circuit is provided to connect the power source to the fuel pump in parallel to the circuit for direct connection between the power source and the fuel pump. A power supply controller is inserted in the other circuit for controlling the supply power depending upon the engine load conditions. The power supply controller supplies a higher voltage to the fuel pump under relatively high engine load conditions and a lower voltage under relatively low engine load conditions.

According to one aspect of the invention, there is provided a fuel pump driver associated with the fuel pump to drive the latter at a controlled speed, a sensor for monitoring a preselected engine operating parameter and producing a sensor signal indicative of the engine operating parameter, a controller responsive to the sensor signal for deriving a desired fuel pump speed value on the basis of the value of the sensor signal and operating the fuel pump driver to drive the fuel pump in accordance with the desired speed in one of a predetermined speed range defined by first maximum speed and a second minimum speed, and a predetermined ultimate speed in excess of the first speed and the controller being responsive to the sensor signal representative of a desired fuel pump speed in excess of the first maximum speed to operate the fuel pump driver to drive the fuel pump at the ultimate speed.

DESCRIPTION OF THE PREFERRED EMBODIMENT

Figure 1:
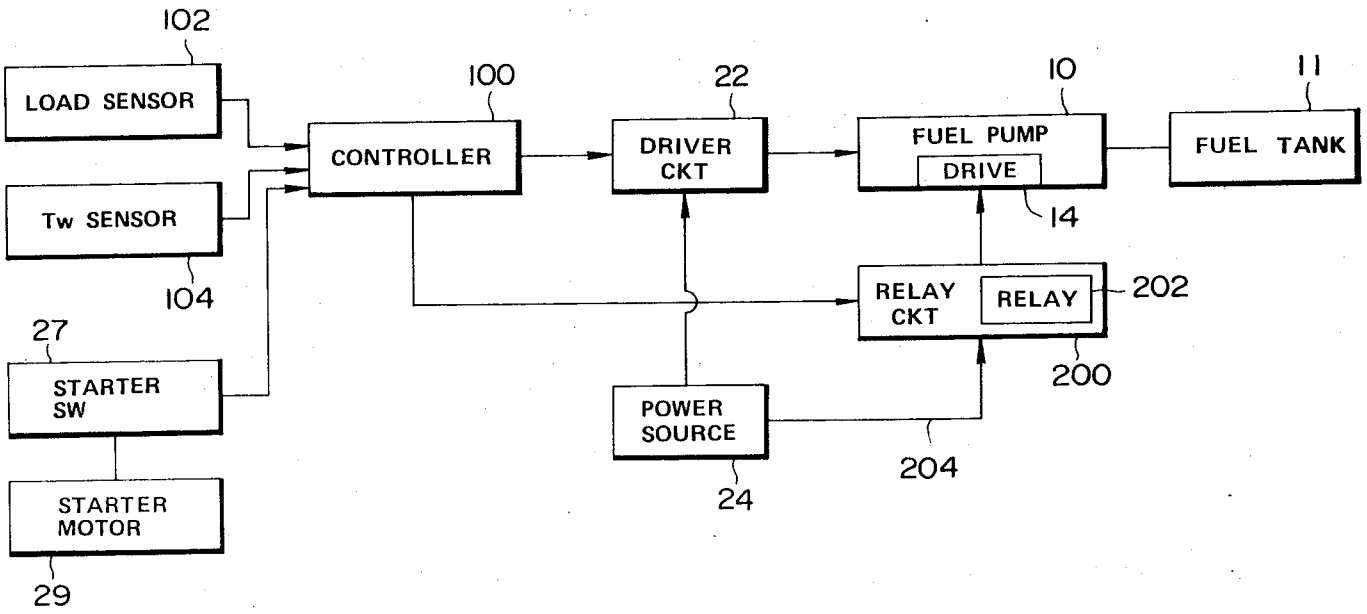
FIG. 1 shows a generalized fuel pump control system according to the invention.
Figure 2:
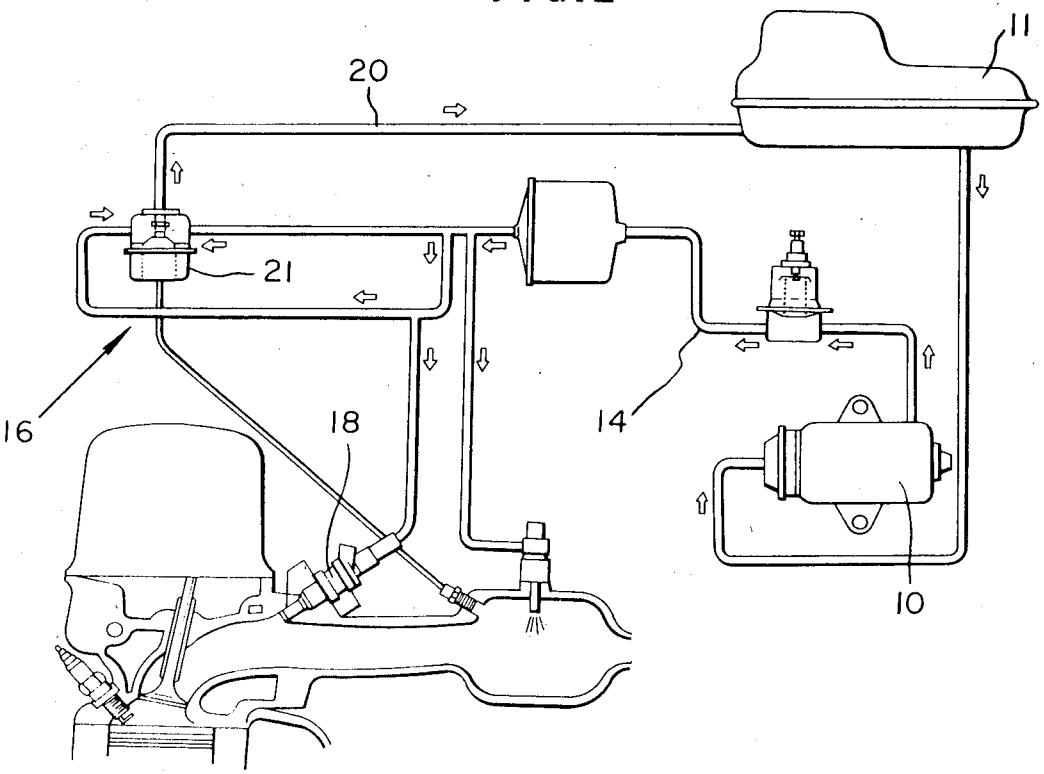
FIG. 2 shows an example of a fuel supply system for a fuel injection internal combustion engine.

Referring now to the drawings, a generalized fuel pump control system according to the present invention is illustrated in FIG. 1. The fuel pump control system includes a fuel pump 10 associated with a fuel tank 11 to draw fuel from the tank and circulate it under pressure through a fuel supply circuit. An example of a fuel supply system for a fuel injection internal combustion engine is diagrammed in FIG. 2. The fuel supply system includes a fuel supply circuit 14 connecting the fuel pump 10 to a gallery 16. The gallery 16 distributes fuel to each of a plurality of fuel injectors 18. A pressure regulator 21 is provided in the fuel supply circuit 14 to return excess fuel to the fuel tank 11 through a fuel return circuit 20.

A controller 100 controls the operation of the fuel pump 10. The controller 100 is connected to an engine load sensor 102 monitoring the load on the engine. Also, the controller 100 is connected to a temperature sensor 104 which senses the temperature of an engine coolant or fuel. The load sensor 102 produces a load-indicative signal indicative of the engine load. The temperature sensor 104 produces a temperature-indicative signal representative of the engine coolant or fuel temperature.

The controller 100 is, in turn, connected to a driver circuit 22 which adjusts the voltage to be applied to a drive 14 of the fuel pump 10. The controller 100 processes the load-indicative signal and the temperature-indicative signal and outputs a control signal which controls the supply voltage of the fuel pump.

In practice, according to the preferred embodiment of the present invention, the controller 100 controls the driver circuit 22 to operate the fuel pump at either a HIGH speed or a LOW speed. When the fuel pump is operated in HIGH speed mode, a higher pressure is applied to the fuel circulating through the fuel supply circuit and discharged through the fuel injectors. On the other hand, when the fuel pump is operated in LOW mode, the fuel circulation rate is limited.

The controller 100 is further connected to a relay circuit 200 including an electromagnetic relay 202. The relay circuit 200 is inserted in a bypass circuit 204 bypassing the driver circuit to establish direct connection between a vehicle battery 24 acting as a power source and the fuel pump 14. The controller 100 operates the relay 202 of the relay circuit 200 to establish direct connection between the battery 24 and the fuel pump 10 when a demand for enrichment beyond a predetermined value is detected on the basis of the load-indicative signal and the temperature-indicative signal.

When the relay circuit 200 closes to establish the above-mentioned direct connection between the battery and the fuel pump, power losses due to the resistance of the power supply lines and circuit elements of the power supply circuit become lower than those occurring when the power is supplied through the driver circuit 22. Therefore, a supply voltage even higher than that supplied in the HIGH speed mode is supplied to the fuel pump to increase the fuel pressure in the fuel supply circuit in response to the enrichment demand exceeding a predetermined value.

In order to detect the enrichment demand exceeding the predetermined value, the controller is also connected to a starter switch 27 which outputs a HIGH-level signal whenever a starter motor 29 is in operation.

In the preferred embodiment, direct connection between the battery and the fuel pump is established in response to the HIGH-level signal from the starter switch 26 and/or whenever the temperature-indicative signal value is greater than a given temperature threshold.

Engine start-up is facilitated by the enrichment of the air/fuel ratio due to the increase in the fuel pressure in the fuel supply circuit during engine cranking. In addition, the increase in fuel pressure in the fuel supply circuit while the engine coolant temperature and/or the fuel temperature remains higher than the given temperature threshold reliably prevents vapor-lock in the fuel supply circuit.

Figure 3:
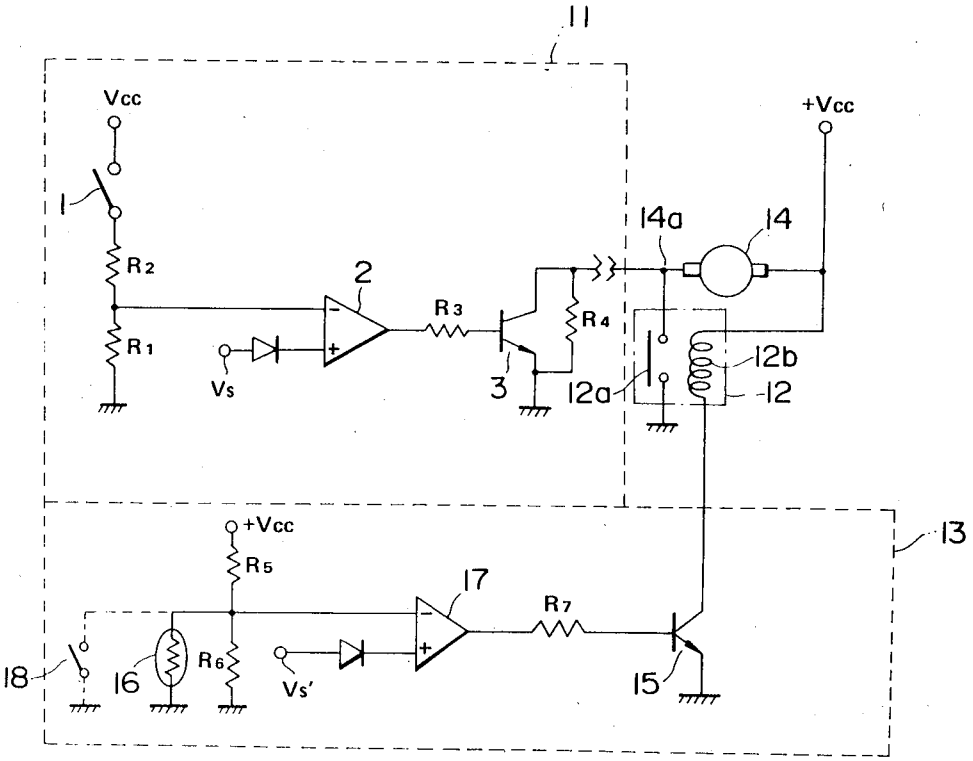
FIG. 3 shows a first embodiment of the fuel pump control system according to the invention.

FIG. 3 shows the first embodiment of the fuel pump control system in accordance with the present invention.

In the shown embodiment, the fuel pump drive 14 is connected to the vehicle battery 24 as indicated by the power source $+V_{cc}$. The fuel pump drive 14 is in turn connected to ground through a power transistor 26, i.e. the collector electrode of the power transistor 26 is connected to the fuel pump and the emittor electrode thereof is connected to ground. A resistor circuit 28 including a resistor 31 bypasses the power transistor to connect the fuel pump drive 14 to ground.

The base electrode of the power transistor 26 is connected to a differential amplifier 30 constituting the controller 100 in conjunction with a voltage divider 32. The divider 32 is connected to the power source $+V_{cc}$ through a throttle switch 34 which acts as the load sensor 102. The throttle switch 34 is closed when the throttle valve open angle is smaller than a given angle. When the throttle valve open angle is less than the given angle and thus the throttle switch is closed, the power source $+V_{cc}$ is connected to the negative input terminal of the differential amplifier 30. The positive input terminal of the differential amplifier 34 is connected a reference signal generator 35 which outputs a reference signal $V_{ref}$ representative of a low load value.

When the throttle switch 34 closes, the potential at the base electrode of the power transistor 26 goes low, cutting off the transistor. As a result, the fuel pump drive 14 is connected to ground through the resistor circuit 28. Thus, a relatively low voltage is supplied to the fuel pump drive 14 so that the fuel pump is driven at a limited speed. On the other hand, when the throttle valve open angle is equal to or greater than the given angle and thus the throttle switch 34 opens, the potential at the base electrode of the power transistor 26 goes HIGH. The power transistor 26 is thus rendered conductive and so connects the fuel pump drive 14 to ground. Since the resistance value of the power transistor 26 is significantly smaller than that of the resistor 30, voltage applied to the fuel pump drive 14 increases sharply, thus driving the fuel pump at a higher speed.

Another grounding circuit 36 with a relay 38 is connected in parallel with the power transistor 26. The relay 38 is a normally-open relay. A relay coil 40 of the relay 38 is connected to a relay control circuit 42 which constitutes part of the controller 100.

The relay control circuit 42 comprises a switching transistor 44 connected to the relay coil 40 at its collector electrode. The base electrode of the switching transistor 44 is connected to a differential amplifier 46. The negative input terminal of the differential amplifier 46 is connected to a thermistor 48 which serves as the temperature sensor 104 for detecting the temperature condition of the fuel, and to a starter switch 27. The resistance of the thermistor 48 increases as the fuel temperature increases. On the other hand, in this embodiment, the starter switch 27 is closed during engine cranking. The thermistor and the starter switch are connected in parallel to each other in the relay circuit. The thermistor 48 and the starter switch 27 form a grounding circuit for the active junction 52 of a voltage divider 52, including resistors 54 and 56.

The positive input terminal of the differential amplifier 46 is connected to a reference signal generator 50 to receive a reference signal indicative of an enrichment criterion. The output of the differential amplifier 46 remains LOW as long as the starter switch is open and/or the thermistor's resistance is higher than a given value. In this case, the transistor 44 remains nonconductive, thus keeping the relay coil deenergized. When the starter switch 27 is closed in order to start cranking the engine or the resistance of the thermistor drops below the given value due to high fuel temperature, the output of the differential amplifier 46 goes HIGH to turn ON the transistor 44. In this case, power is applied to the relay coil 40 to energize the latter. Then, the relay 38 is closed to ground the fuel pump drive 14.

The relay 38 is disposed near the fuel pump 10 to shorten the length of wiring needed to connect the drive 14 to ground. This minimizes the resistance of the grounding circuit, thus allowing a higher voltage to be supplied to the fuel pump drive 14. As a result, the fuel pump speed can be boosted even higher than in the HIGH speed mode.

It should be appreciated that the shown embodiment is applicable for the fuel pumps of rotary type, centrifugal type and so forth. In addition, the sensor detecting the enrichment demand is not limited to the shown thermistor and starter switch but can be any sort of sensor which can detect a relatively high load on the engine. For example, a full throttle position sensor, airflow sensor or the like can be used as a replacement for the starter switch, and an engine coolant temperature sensor can be used as a replacement for the thermistor for detecting the fuel temperature.

Figure 4:
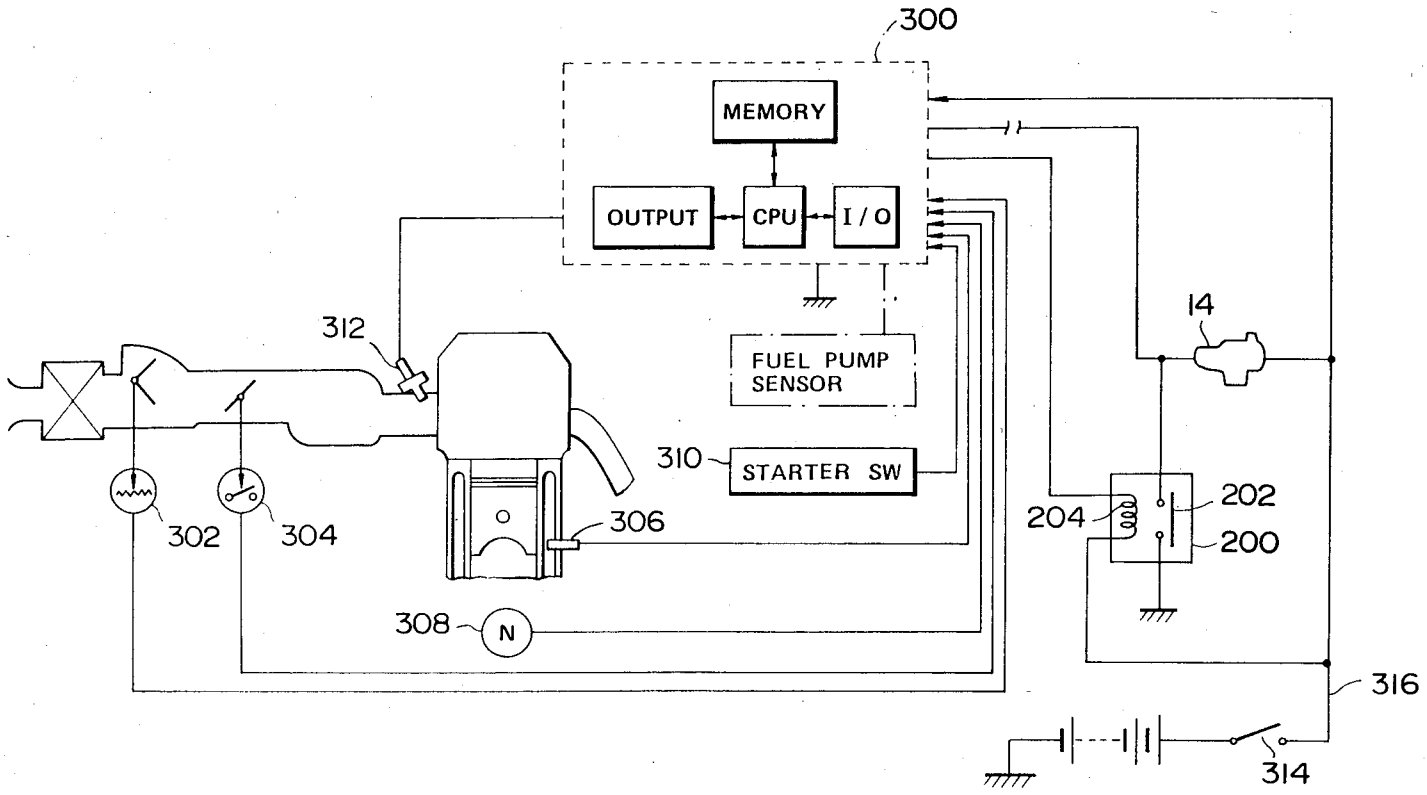
FIG. 4 shows a amend embodiment of the fuel pump control system according to the invention.

FIG. 4 shows the second embodiment of a fuel pump control system according to the present invention. In this embodiment, a relay circuit 200 is disposed near the fuel tank as in the aforementioned first embodiment. On the other hand, a fuel pump drive 14 is connected to a controller 300 which controls fuel injection quantity, fuel injection timing and related parameters.

The controller 300 controls fuel injection on the basis of various control parameters from various sensors, such as an airflow meter 302, a throttle sensor 304, an engine coolant temperature sensor 306, an engine speed sensor 308, and a starter switch 310. The controller performs calculations utilizing the air flow rate-indicative signal from the airflow meter 302, a throttle valve angular position-indicative signal from the throttle sensor 304, the engine coolant temperature-indicative signal from the coolant temperature sensor 306, the engine speed-indicative signal from the engine speed sensor 308 and the starter switch signal to derive the fuel injection quantity to be injected through a fuel injection valve 312 in a per se well-known manner.

The controller 300 is also connected to the fuel pump drive 14. The drive 14 is, in turn, connected to a vehicle battery 312 through the ignition switch 314. Normally, electric power is supplied from the battery 312 to the fuel pump drive 14 through the circuit 316 including the ignition switch 314. The controller 300 derives a control signal for controlling operation of the fuel pump on the basis of engine load conditions indicated by the airflow rate-indicative signal and/or the throttle valve angular position-indicative signal, engine coolant temperature-indicative signal and/or the starter switch position.

The fuel pump drive 14 is also connected to the vehicle battery 312 through a bypass circuit 318 including the relay circuit 200. The relay circuit 200 comprises a normally-open relay switch 202 and a relay coil 204. The relay coil is connected to the controller to receive an actuation signal when desired air/fuel mixture enrichment exceeds a given value. As in the first embodiment, the controller 300 outputs an actuation signal to enrich the air/fuel ratio during engine cranking. Accordingly, the actuation signal is produced in response to closure of the starter switch. The engine coolant temperature signal value may be used as an additional factor for activating the relay circuit 200 to establish direct connection between the battery and the fuel pump drive. When the engine coolant temperature-indicative signal value is greater than a given temperature threshold, the controller 300 outputs the actuation signal to operate the fuel pump at an increased speed.

Figure 5:
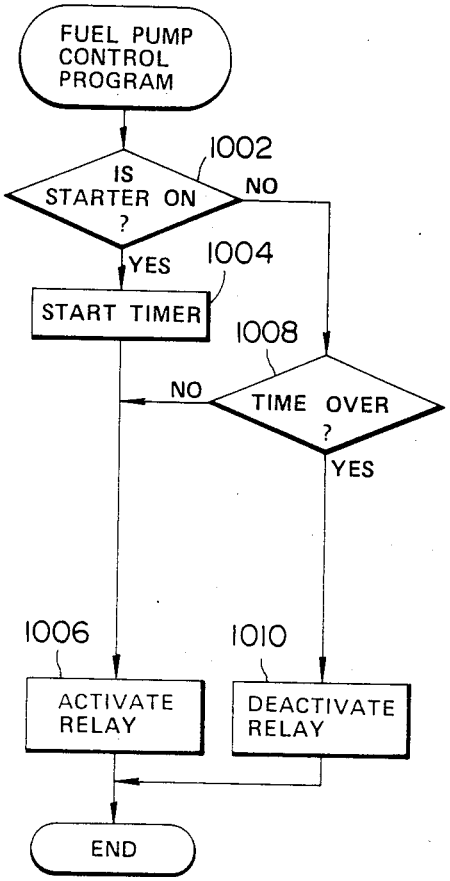
FIG. 5 shows a flowchart of the program executed by the FIG. 4 embodiment.

FIG. 5 is a flowchart of a fuel pump control program executed by the controller 300 of FIG. 4. In this flowchart, the controller 300 is responsive to the starter-on signal produced while the starter switch is closed to output the actuation signal to the relay circuit 320.

At a step 1002, the starter switch position is checked by monitoring the input level from the starter switch 310. As the starter-on signal is a HIGH-level signal which remains HIGH throughout the engine cranking period, closure of the starter switch 310 can be detected by detecting the rising edge of the HIGH-level starter-on signal from the starter switch. After closure of the starter switch 310 is detected, a timer is started at a step 1004. Thereafter, the actuation signal is continuously output to the relay coil 204 to energize the latter. When energized by the actuation signal at a step 1006, the relay coil 204 closes the relay switch 322. As a result, the bypass circuit 318 is completed to supply electric power from the battery to the fuel pump drive 14.

As mentioned previously, since the relay circuit 200 is disposed near the fuel pump drive 14, voltage drops due to the resistance of the wiring is minimized and thus the fuel pump 10 can be driven at a higher speed than in the HIGH-speed mode while power is supplied through the circuit 316.

In cases where the open-to-closed actuation of the starter switch is not detected when checked at the step 1002, then the timer value t is checked to see if it indicates expiration of a predetermined period of time, e.g. 30 sec., at a step 1008. This step 1008 and the step 1004 are provided to maintain the fuel pump speed at the highest possible level for at least the predetermined period of time. This ensures a fuel supply adequate to start the engine.

When the timer value is less than the predetermined period of time, when the program goes to the step 1006 to continue outputting the actuation signal. On the other hand, after the predetermined period of time expires, the actuation signal is terminated. As a result, the relay coil 204 is deenergized so that the relay switch returns to its normal open position, at a step 1010. After the relay circuit 200 is disabled upon termination of the actuation signal, the battery power is supplied to the fuel pump drive 14 via the circuit 316. Since the circuit 316 has a higher overall resistance than the bypass circuit 318, the operational speed of the fuel pump drops below that obtained while the relay circuit 200 is active, even in HIGH-speed mode.

After the steps 1006 and 1010, the current cycle of control program execution ends.

Figure 6:
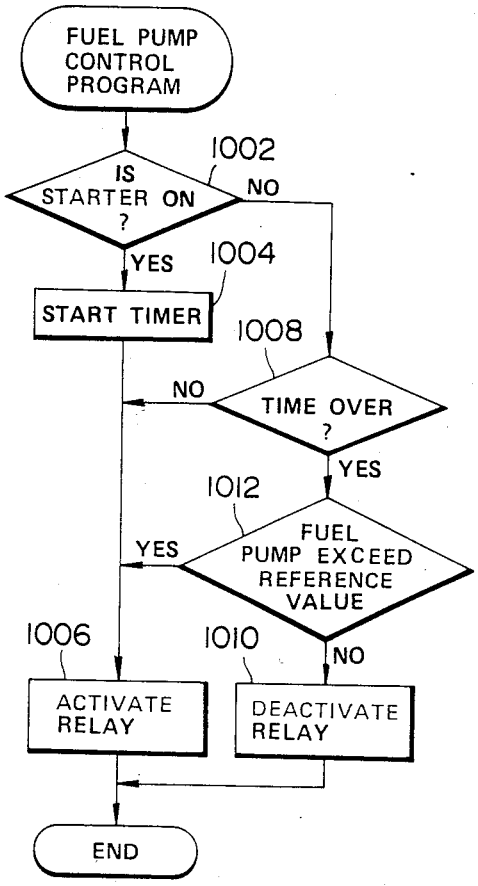
FIG. 6 shows a modified control program executed by the controller 300 of FIG. 4.

FIG. 6 shows a modified control program executed by the controller 300 of FIG. 4. Since in this modified control program, the actuation signal is produced when either the starter switch is closed or the fuel temperature is higher than a given temperature, a fuel temperature sensor 320 is connected to the controller as shown in phantom lines in FIG. 4.

In order to output the actuation signal when the fuel temperature is higher than the given temperature, a step 1012 is inserted between the steps 1008 and 1010 of FIG. 5. In the step 1012, the fuel temperature-indicative signal from the fuel temperature sensor 320 is compared with a reference value which is representative of the given temperature. When the fuel temperature-indicative signal value is greater than the reference value, the program goes to the step 1006, whereby the actuation signal energizes the relay coil 204. On the other hand, when the fuel temperature-indicative signal value is equal to or less than the reference value, then the program goes to the step 1010 to terminate the actuation signal and so deenergize the relay coil 204.

It should be appreciated, although the second embodiment has been directed toward control of the fuel pump speed by means of the relay circuit, the same control can be performed to adjusting the control signal value directly, thus obviating the need for the relay circuit. In this case, the control signal may represent a desired fuel pump speed. In cases where the fuel pump drive 14 drives a rotary-type or centrifugal-type fuel pump, the control signal may be converted into analog signal to control the fuel pump speed in proportion to its analog voltage level. On the other hand, if the fuel pump is of the diaphragm type or the electromagnetic plunger type, a digital control signal representative of the drive duty cycle may be applied to the fuel pump drive.

As set forth above, according to the present invention, fuel pressure in the fuel supply system can be increased to a sufficient level when an especially rich air/fuel mixture is required.

What is claimed is:

1. A control system for a fuel pump in a fuel supply system for an internal combustion engine comprising:

a fuel pump driver associated with said fuel pump to drive the latter at a controlled speed;

a sensor for monitoring a preselected engine operating parameter and producing a sensor signal indicative of the engine operating parameter;

a controller responsive to said sensor signal for deriving a desired fuel pump speed value on the basis of the value of said sensor signal and operating said fuel pump driver to drive said fuel pump in accordance with said desired speed in one of a predetermined speed range defined by a first maximum speed and a second minimum speed, and a predetermined ultimate speed in excess of said first speed and said controller being responsive to the sensor signal representative of a desired fuel pump speed in excess of said first maximum speed to operate said fuel pump driver to drive said fuel pump at said ultimate speed.

2. The control system as set forth in claim 1, which further comprises a first power supply line for supplying said fuel pump driver with electric power sufficient to drive said fuel pump within said predetermined speed range between said first and second speeds, and a normally-open second power supply line supplying said fuel pump driver with electrical power sufficient to drive said fuel pump at said ultimate speed, said second power supply line being closed in response to a control signal produced by the controller when said desired speed exceeds said first speed.

3. The control system as set forth in claim 2, wherein said fuel pump driver is an electric motor, the operating speed of which depends upon the voltage supplied thereto.

4. A control system for a fuel pump in a fuel supply system for an internal combustion engine comprising:

a fuel pump driver associated with said fuel pump to drive the latter at a controlled speed;

a sensor for monitoring a preselected engine operating parameter and producing a sensor signal indicative of the engine operating parameter;

a controller responsive to said sensor signal for deriving a desired fuel pump speed value on the basis of the value of said sensor signal and operating said fuel pump driver to drive said fuel pump in accordance with said desired speed in one of a predetermined speed range defined by a first maximum speed and a second minimum speed, and a predetermined ultimate speed in excess of said first speed and said controller being responsive to the sensor signal representative of a desired fuel pump speed in excess of said first maximum speed to operate said fuel pump driver to drive said fuel pump at said ultimate speed;

a first power supply line for supplying said fuel pump driver with electric power sufficient to drive said fuel pump within said predetermined speed range between said first and second speeds; and a normally-open second power supply line supplying said fuel pump driver with electrical power sufficient to drive said fuel pump at said ultimate speed, said second power supply line being closed in response to a control signal produced by the controller when said desired speed exceeds said first speed;

wherein said fuel pump driver is an electric motor, the operating speed of which depends upon the voltage supplied thereto; and wherein said second power supply line has a lower effective resistance than said first power supply line.

5. The control system as set forth in claim 4, wherein said controller responds to closure of a starter switch to calculate a desired fuel pump speed in excess of said first speed.

6. The control system as set forth in claim 4, wherein said controller responds to a signal from a fuel temperature sensor to calculate a desired fuel pump speed in excess of said first speed whenever the fuel temperature detected by said fuel temperature sensor is higher than a given temperature threshold.

7. The control system as set forth in claim 5, which further comprises means for holding said desired fuel pump speed in excess of said first speed for a given period of time.

8. The control system as set forth in claim 4, wherein said second power supply line includes a normally-open relay circuit closed by said controller when the desired fuel pump speed exceeds said first speed.

9. The control system as set forth in claim 8, wherein said relay circuit is disposed near said fuel pump so as to be connected to said fuel pump driver via the shortest possible wiring.

10. A control system for a fuel pump in a fuel supply system for an internal combustion engine comprising:

a fuel pump driver associated with said fuel pump to drive the latter at a controlled speed;

a sensor for monitoring a preselected engine operating parameter and producing a sensor signal indicative of the engine operating parameter; and a controller responsive to said sensor signal for deriving a desired fuel pump speed value on the basis of the value of said sensor signal and operating said fuel pump driver to drive said fuel pump in accordance with said desired speed in one of a predetermined speed range defined by a first maximum speed and a second minimum speed, and a predetermined ultimate speed in excess of said first speed and said controller being responsive to the sensor signal representative of a desired fuel pump speed in excess of said first maximum speed to operate said fuel pump driver to drive said fuel pump at said ultimate speed;

wherein said controller responds to closure of a starter switch to calculate a desired fuel pump speed in excess of said first speed.

11. The control system as set forth in claim 10, further comprising a first power supply line for supplying said fuel pump driver with electric power sufficient to drive said fuel pump within said predetermined speed range between said first and second speeds, and a normally-open second power supply line supplying said fuel pump driver with electrical power sufficient to drive said fuel pump at said ultimate speed, said second power supply line being closed in response to a control signal produced by the controller when said desired speed exceeds said first speed.

12. The control system as set forth in claim 10, which further comprises means for holding said desired fuel pump speed in excess of said first speed for a given period of time.

13. A control system for a fuel pump in a fuel supply system for an internal combustion engine comprising:

a fuel pump driver associated with said fuel pump to drive the latter at a controlled speed;

a sensor for monitoring a preselected engine operating parameter and producing a sensor signal indicative of the engine operating parameter; and a controller responsive to said sensor signal for deriving a desired fuel pump speed value on the basis of the value of said sensor signal and operating said fuel pump driver to drive said fuel pump in accordance with said desired speed in one of a predetermined speed range defined by a first maximum speed and a second minimum speed, and a predetermined ultimate speed in excess of said first speed and said controller being responsive to the sensor signal representative of a desired fuel pump speed in excess of said first maximum speed to operate said fuel pump driver to drive said fuel pump at said ultimate speed;

wherein said controller responds to a signal from a fuel temperature sensor to calculate a desired fuel pump speed in excess of said first speed whenever the fuel temperature detected by said fuel temperature sensor is higher than a given temperature threshold.

14. The control system as set forth in claim 13, further comprising a first power supply line for supplying said fuel pump driver with electric power sufficient to drive said fuel pump within said predetermined speed range between said first and second speeds, and a normally-open second power supply line supplying said fuel pump driver with electrical power sufficient to drive said fuel pump at said ultimate speed, said second power supply line being closed in response to a control signal produced by the controller when said desired speed exceeds said first speed.

* * * * *